United States Patent [19]

Washino et al.

[11] Patent Number: 4,903,665

[45] Date of Patent: Feb. 27, 1990

[54] AIR-FUEL RATIO CONTROL APPARATUS FOR AN INTERNAL COMBUSTION ENGINE

[75] Inventors: Shoichi Washino; Satoru Ohkubo, both of Amagasaki, Japan

[73] Assignee: Mitsubishi Denki Kabushiki Kaisha, Tokyo, Japan

[21] Appl. No.: 250,244

[22] Filed: Sep. 28, 1988

[30] Foreign Application Priority Data

Sep. 29, 1987 [JP] Japan ..... 62-246562
Sep. 29, 1987 [JP] Japan ..... 62-246563

[51] Int. Cl.[4] ..... F02D 41/04; F02M 51/00
[52] U.S. Cl. ..... 123/435; 364/431.08
[58] Field of Search ..... 123/425, 435, 478; 364/431.04, 431.05, 431.08

[56] References Cited

U.S. PATENT DOCUMENTS 4,356,551 10/1982 Iwase et al. ..... 364/431.08
4,606,312 8/1986 Nakano et al. ..... 123/435 X
4,699,106 10/1987 Haraguchi et al. ..... 123/435 X
4,711,212 12/1987 Haraguchi et al. ..... 123/435 X
4,732,126 3/1988 Ikeura et al. ..... 123/435
4,800,500 1/1989 Tanaka ..... 123/425 X
4,843,556 6/1989 Wakeman et al. ..... 364/431.04 X

FOREIGN PATENT DOCUMENTS 3635963 5/1987 Fed. Rep. of Germany .
3704839 8/1987 Fed. Rep. of Germany .
0212643 10/1985 Japan .
0015466 4/1988 Japan .

*Primary Examiner*—Willis R. Wolfe
*Attorney, Agent, or Firm*—Oblon, Spivak, McClelland, Maier & Neustadt

[57] ABSTRACT

An air-fuel ratio control apparatus for an internal combustion engine operates a signal of inner pressure of cylinder and a signal of crank angle position to obtain the maximum value of a rate of pressure increase in an ignition cycle or the mean value of the maximum values in a predetermined number of cycles, whereby a fuel injection quantity is controlled by using said value. An exhaust gas temperature may be used as well as the signals of the inner pressure of cylinder and the crank angle. In this case, a fuel injection quantity is controlled on the basis of a state quantity obtained by calculating the inner pressure of cylinder and a temperature of exhaust gas.

8 Claims, 20 Drawing Sheets

GRAPHICALLY REPRESENTED EFFECTIVE AVERAGE VALUE
(360 SAMPLES) Pi(kg/cm²)
9.0
8.0
7.0
4.0
3.0
2.0
ENGINE REV. NUMBER
INTAKE AIR PRESSURE
SYM-BOL
rpm
mmHg
△
2000
-100
○
1500
-400
10
12
14
16
18
20
A/F

| Tp (ms) | 800 | 2000 | 3200 | 4000 | 4800 | 5600 | 6400 |
|---|---|---|---|---|---|---|---|
| | 20 | 30 | 30 | 40 | 40 | 40 | 40 |
| 5 | 15 | 20 | 20 | 20 | 30 | 30 | 40 |
| 4 | 10 | 10 | 10 | 15 | 20 | 25 | 35 |
| 3 | 10 | 0 | 0 | 10 | 15 | 20 | 30 |
| 2 | 10 | 0 | 0 | 10 | 15 | 20 | 25 |
| 1 | 10 | 0 | 0 | 10 | 15 | 20 | 20 |
| 0 | | | | | | | |

ENGINE REVOLUTION NUMBER (rpm)

AIR-FUEL RATIO CONTROL APPARATUS FOR AN INTERNAL COMBUSTION ENGINE

BACKGROUND OF THE INVENTION

1. Field of the invention

The present invention relates to an air-fuel ratio control apparatus for an internal combustion engine for controlling an air-fuel ratio in a gas mixture supplied to the internal combustion engine.

2. Discussion of background

There have been proposed various types of fuel control apparatus. A conventional fuel control apparatus as described in Japanese Unexamined Patent Publication No. 212643/1985 will be described. FIG. 16 is a diagram showing a conventional fuel control apparatus.

In FIG. 16, a numeral 1 designates an air cleaner, a numeral 2 an air-flow meter for measuring an intake air quantity, a numeral 3 a throttle valve, a numeral 4 an intake air manifold, a numeral 5 a cylinder, a numeral 6 a water temperature sensor for detecting a temperature of cooling water, a numeral 7 a crank angle sensor, a numeral 8 an exhaust air manifold, a numeral 9 an exhaust gas sensor for detecting the concentration of a component (for instance, oxygen concentration) in exhaust gas, a numeral 10 a fuel injection valve, a numeral 11 an ignition plug, and a numeral 12 a control apparatus.

A crank angle sensor outputs a reference position pulse for each reference position of crank angle (each 180° for a four cylinder engine and each 120° for a six cylinder engine) and a unit angle pulse for each unit angle (for instance, each 1° ).

A crank angle can be detected by counting the number of unit angle pulses after a reference position pulse has been read by the control apparatus 12. The number of revolution of engine is also detected by measuring a frequency or a period of the unit angle pulses.

In the example of FIG. 16, the crank angle sensor 7 is disposed in a distributor.

A control apparatus 12 is constituted by a micro computer comprising, for instance, a CPU, an RAM, an ROM and an input output interface. The control apparatus 12 receives an intake air quantity signal S1 from the air-flow meter 2, a water temperature signal S2 from the water temperature sensor 6, a crank angle signal S3 from the crank angle sensor 7, an exhaust gas signal S4 from the exhaust gas sensor 9, a battery voltage signal and a throttle full-opening signal and so on, and operates the signals to thereby calculate a value of fuel injection quantity to be supplied to the engine, whereby a fuel injection signal S5 is outputted. A fuel injection valve 10 is actuated by the signal S5 to thereby supply a predetermined amount of fuel to the engine.

Calculation of a fuel injection quantity $T_i$ is conducted in the control apparatus 12 by using the following equation:

$$T_i = T_p \times (1 + F_t + KMR/100) \times \beta + T_s \quad (1)$$

where $T_p$ is a basic injection quantity which is obtained by a formula $T_p = K \times Q/N$ where Q is an intake air flow rate, N is an engine revolution number and K is a constant, $F_t$ is a correction coefficient corresponding to a cooling water temperature for the engine which assumes a greater value as the water temperature decreases, and KMR is a correction coefficient of a heavy load (for instance, it is memorized in a data table as a value corresponding to both the basic injection quantity $T_p$ and the engine revolution number N, the coefficient being readable from the data table, $T_s$ is a correction coefficient changing dependent on a battery voltage, which is to correct variation in voltage to actuate the fuel injection valve 10, and $\beta$ is a correction coefficient corresponding to the exhaust gas signal S4 from the exhaust air sensor 9, by which a feed-back control of the air-fuel ratio of a gas mixture can be effect so that the air-fuel ratio is maintained at a predetermined value, i.e. at or near a theoretical air-fuel ratio of 14.6.

Since the air-fuel ratio of the gas mixture is controlled at a constant level by the feed-back control, correction by the cooling water temperature and correction by the heavy load coefficient become meaningless. Accordingly, the feed-back control by the exhaust gas signal S4 can only be conducted when the correction coefficient $F_t$ of the water temperature and the correction coefficient KMR of the heavy load are zero. FIG. 18 shows the relation between the items of correction and sensors.

The conventional fuel control apparatus is so adapted that while a feed-back control is carried out in response to the signal of the exhaust gas sensor, correction under a heavy load condition is made in accordance with a basic fuel injection quantity $T_p$ and an engine revolution speed N, i.e. an intake air quantity Q and an engine revolution speed N. In other words, the correction is made by an open loop control. Accordingly, there is a possibility that an air-fuel ratio is deviated from the optimum air-fuel ratio (the optimum air-fuel ratio is to obtain the greatest torque, which has usually a valve of 13 or around which is different from a value for a feed-back control of air-fuel ratio) due to scattering of the air-flow meter or the fuel injection valve, and deterioration of them with time. When, such phenomenon takes place, a stable operation of engine can not be obtained.

Further, since the air-flow meter measures a quantity of air staying in the intake air pipe as well as an amount of air sucked into the engine, a value obtained by the feed-back control of air-fuel ratio does not indicate the true value.

SUMMARY OF THE INVENTION

It is an object of the present invention to provide an air-fuel ratio control apparatus for an internal combustion engine capable of controlling an air-fuel ratio to give a predetermined value regardless of the condition of the engine.

According to the present invention, there is provided an air-fuel ratio control apparatus for an internal combustion engine adapted to measure an intake air quantity and an engine revolution number to thereby calculate a basic fuel injection quantity based on the measured intake air quantity and the engine revolution number and to output an instruction signal to inject an amount of fuel to a cylinder, which comprises a pressure detecting means to detect an inner pressure of cylinder, a crank angle detecting means to detect a crank angle of the engine, and a control device which is adapted to receive the output signals of the pressure detecting means and the crank angle detecting means so as to obtain the maximum value of a rate of pressure increase in an ignition cycle of the engine or the mean value of the maximum values in a predetermined number of cycles of the engine, and to control a fuel injection quantity in response to the thus obtained maximum value or the mean value.

In accordance with another aspect of the present invention, there is provided an air-fuel ratio control apparatus for an internal combustion engine adapted to measure an intake air quantity and an engine revolution number to thereby calculate a basic fuel injection quantity based on the measured intake air quantity and the engine revolution number and to output an instruction signal to inject an amount of fuel to a cylinder, which comprises a pressure detecting means to detect an inner pressure of cylinder, a crank angle detecting means to detect a crank angle of the engine, an exhaust gas temperature detecting means to detect a temperature of exhaust gas and a control device which is adapted to receive the output signals of the pressure detecting means, the crank angle detecting means and the exhaust gas temperature detecting means, to calculate a state quantity based on the signals of the inner pressure of cylinder in an ignition cycle, and to control a fuel injection quantity by using the state quantity and a value of exhaust gas temperature $T_e$ obtained by the output of the exhaust gas temperature detecting means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
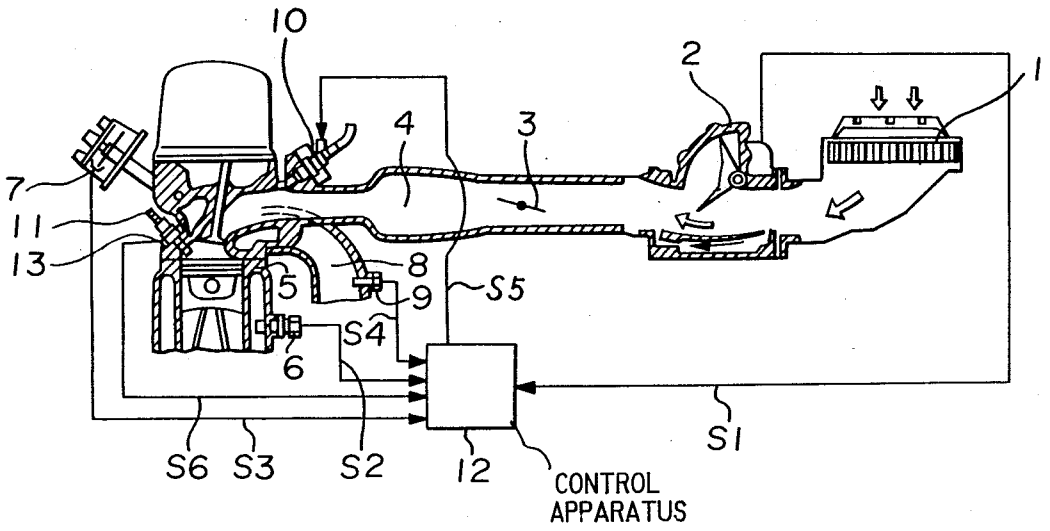
FIG. 1 is a diagram showing an embodiment of the air-fuel ratio control apparatus for an internal combustion engine according to the present invention.
Figure 16:
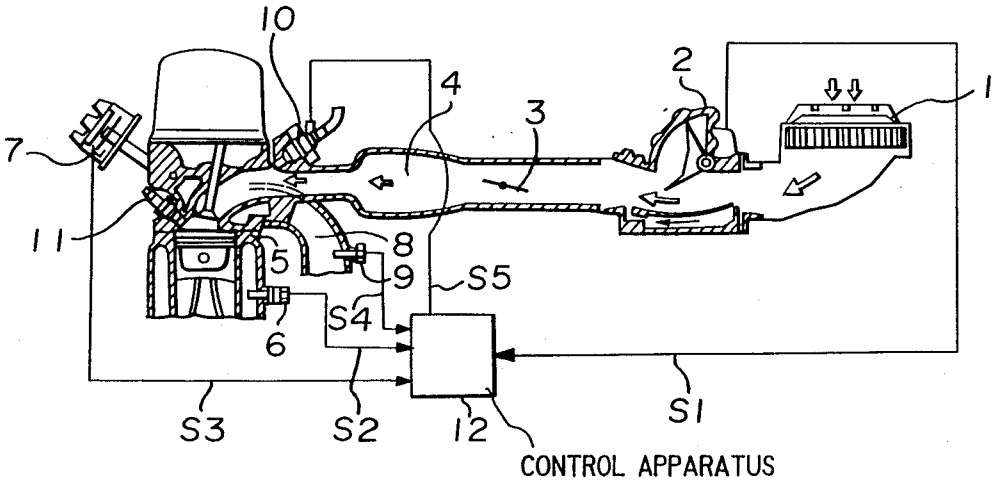
FIGURE 16 PRIOR ART
FIG. 16 is a diagram showing a conventional air-fuel ratio control apparatus.
Figures 17, 18:
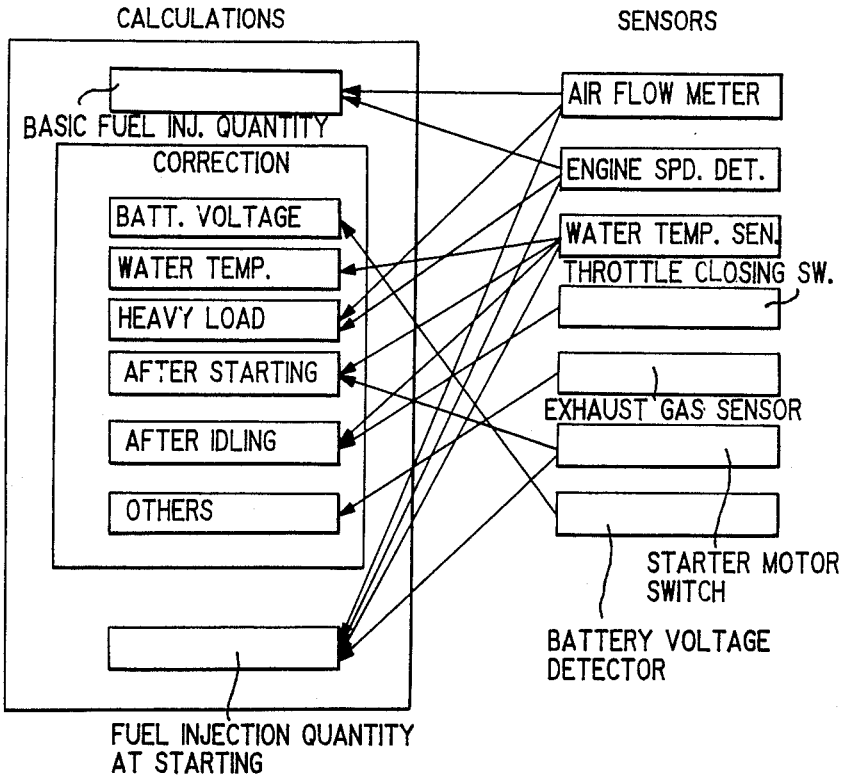
FIGURE 17 PRIOR ART
FIGURE 18 PRIOR ART
FIG. 17 is a diagram showing a data table concerning a relation of engine revolution speeds to basic injection quantities to explain the operation of the air-fuel ratio control apparatus shown in FIG. 16.
FIG. 18 is a diagram showing the relation between the items of operations of correction and sensors in the conventional air-fuel ratio control apparatus.

Referring to the drawings, wherein the same reference numerals designate the same or corresponding parts throughout the several views, and more particularly to FIG. 1 thereof, there is shown a diagram of an embodiment of the air-fuel ratio control apparatus of the present invention. In FIG. 1, the elements indicated by reference numerals 1–12 are the same as those in FIG. 16, and therefore, description of these elements is omitted.

A reference numeral 13 designates a pressure sensor to detect an inner pressure of cylinder. The pressure sensor 13 is used in place of a sheet metal for an ignition plug 11 so that it detects variations in pressure in a cylinder to output electric signals. The control apparatus 12 is constituted by, for instance, a microcomputer, and is adapted to receive the intake air quantity signal S1 of the air-flow meter 2, the water temperature signal S2 of the water temperature sensor 6, the crank angle signal S3 of the crank angle sensor 7, the exhaust gas signal S4 of the exhaust gas sensor 9 and the pressure signal S6 of the pressure sensor 13 to thereby operate the signals so that the fuel injection valve 10 is controlled by fuel injection signals S5.

Figure 2:
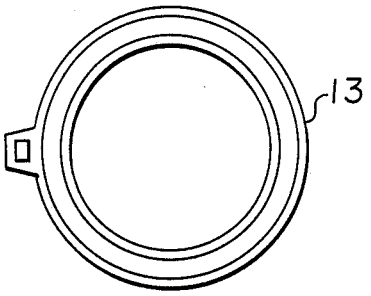
FIG. 2A is a plane view showing an embodiment of a pressure sensor used for the embodiment shown in FIG. 1.
FIG. 2B is a vertical cross-sectional view of the pressure sensor in FIG. 2A.
Figure 2:
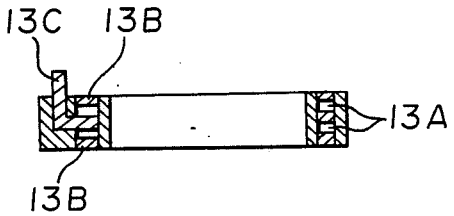

FIG. 2 shows an embodiment of the pressure sensor 13, in which FIG. 2A is a front view and FIG. 2B is a vertical cross-sectional view of FIG. 2A.

In FIG. 2B, a numeral 13A designates a piezoelectric element, a numeral 13B designates a pair of negative electrodes and a numeral 13C designates a positive electrode.

Figure 3:
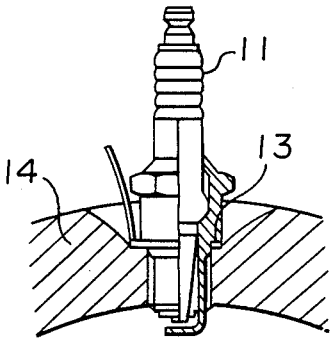
FIG. 3 is a front view partly cross-sectioned showing a state of fitting the pressure sensor shown in FIG. 2.

FIG. 3 is a diagram showing the pressure sensor 13 being fitted to a cylinder head 14 by fastening an ignition plug 11.

Figure 4:
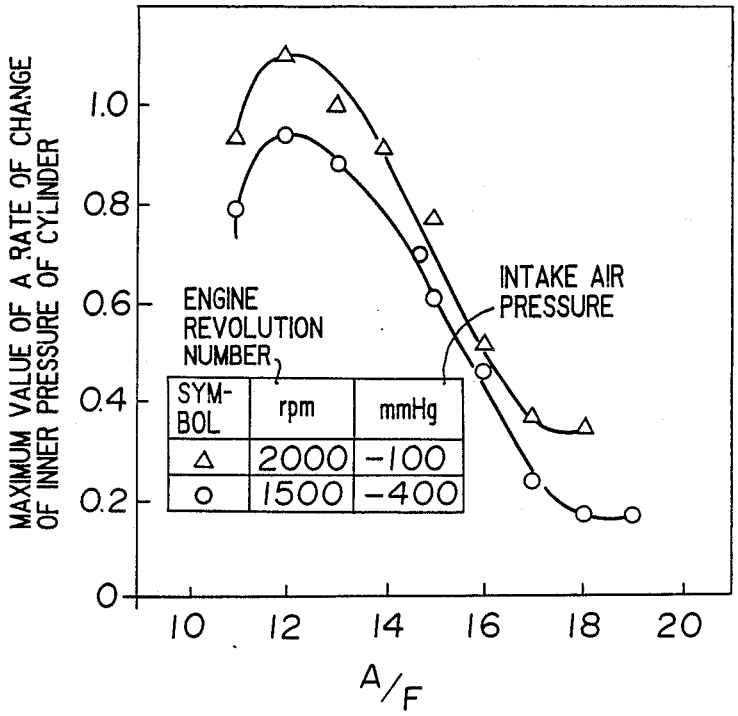
FIG. 4 is a characteristic diagram showing the relation between the maximum value of rate of pressure increase in an ignition cycle and air-fuel ratio to illustrate the embodiment shown in FIG. 1.

FIG. 4 shows the relation between an air-fuel ratio and the maximum value of a rate of pressure increase $dP/d\theta$ in a cylinder in an ignition cycle as the essential feature of the present invention. The ordinate represents a maximum value of a rate of pressure increase ($dP/d\theta$) and the abscissa represents an air-fuel ratio. It is understood from FIG. 4 that the relation between the maximum value and the air-fuel ratio is shown in a curve even though a load and an engine revolution speed have any values.

The inventors of this application have found the above-mentioned fact as a result of extensive experiments. This shows a general trend that when an air-fuel ratio is thick, a combustion speed is large and a maximum value of a pressure increasing rate is large, and on the other hand, when an air-fuel ratio is thin, a combustion speed is low, hence, a maximum value of a pressure increasing rate is small. Accordingly, the maximum value of a pressure increasing rate $(dP/d\theta)_{max}$ in a cylinder in an ignition cycle has a one to one relation with respect to an air-fuel ratio regardless of a load and an engine revolution number, and in particular, this tendency is remarkable in the vicinity of in theoretical air-fuel ratio.

In the present invention, an air-fuel ratio in an ignition cycle or in a predetermined number of cycles can be obtained by detecting the maximum value of a pressure increasing rate $(dP/d\theta)_{max}$ in a cylinder in an ignition cycle or the mean value $(dP/d\theta)_{max}$ in a predetermined number of cycles, whereby an air-fuel ratio in each cycle or in a predetermined number of cycles can be controlled by monitoring the maximum value $(dP/d\theta)_{max}$ of pressure increasing rate in an ignition cycle or mean value of a predetermined number of cycles.

There is established an equation $d\theta=6$ Ndt since a relation of $\theta=6$ Nt is established between an crank angle $\theta$ and a time t. Accordingly, $(dP/d\theta)_{max}=(dP/dt)$ max/(6N), if an engine revolution number N is constant. Then, it is possible to control an air-fuel ratio in each cycle even by detecting $(dP/dt)_{max}$ in place of $(dP/d\theta)_{max}$. Accordingly, it is possible to control an air-fuel ratio in the condition not only of a heavy load but also of a trandient time at the time operating an accelerator pedal, by detecting the value $(dP/dt)_{max}$.

A control of air-fuel ratio by detecting an inner pressure of cylinder in an ignition cycle is possible by measuring a maximum inner pressure $P_{max}$ in cylinder in an ignition cycle or a graphically represented effective mean value $P_i$ besides the method of detecting the value $(dP/d\theta)_{max}$ as described above.

Figure 5:
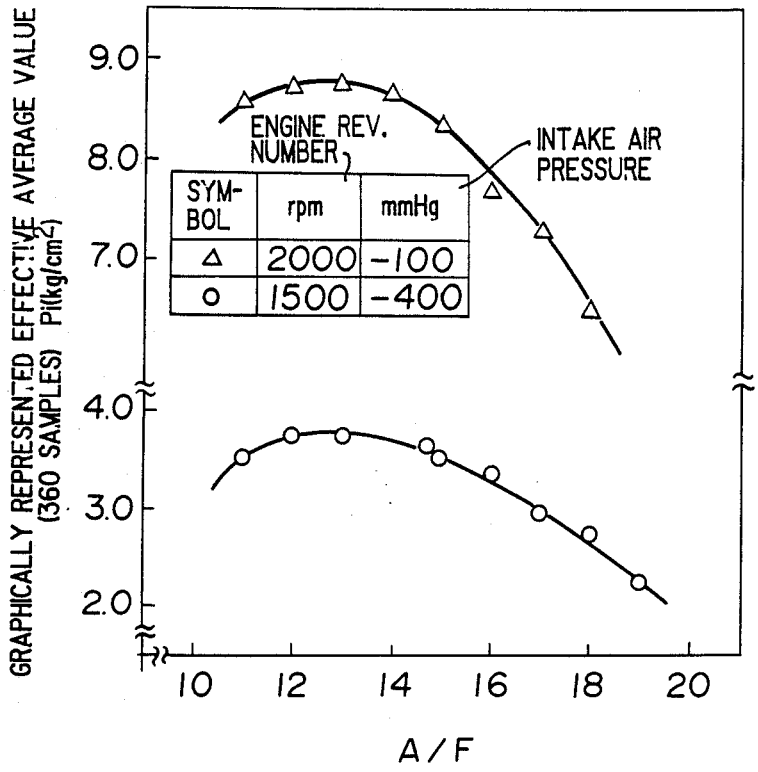
FIG. 5 is a characteristic diagram showing the relation between graphically represented effective average pressures $P_i$ and air-fuel ratios to illustrate the above-mentioned embodiment.
Figure 6:
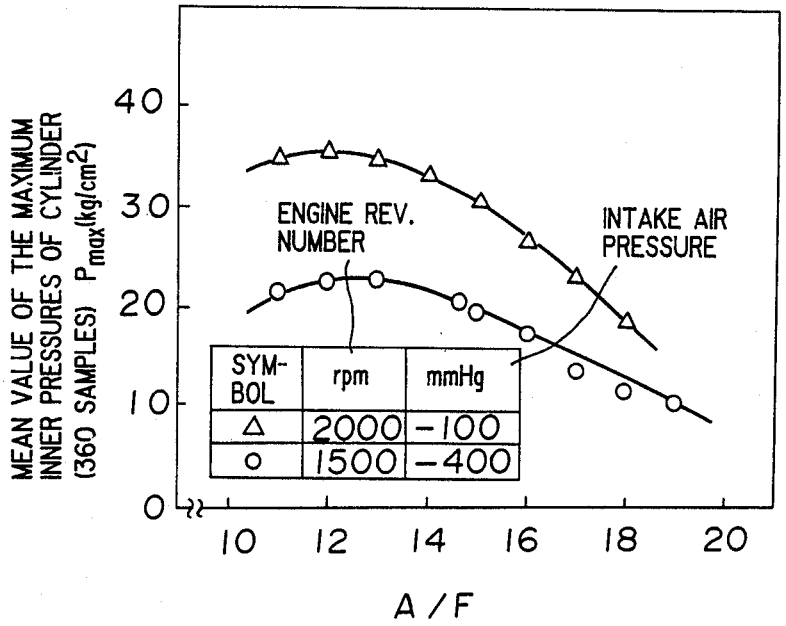
FIG. 6 is a characteristic diagram showing the relation of the mean value of the maximum values $P_{max}$ of inner pressure of cylinder in an ignition cycle and air-fuel ratio to explain the above-mentioned embodiment.

FIGS. 5 and 6 respectively show the relation between a graphically represented effective mean value of pressure $P_i$ and an air-fuel ratio and between a maximum pressure $P_{max}$ and an air-fuel ratio. From these Figures, it is possible to consider a method of controlling an air-fuel ratio by measuring the graphically represented effective mean value of pressure $P_i$ and a maximum pressure $P_{max}$ in cylinder in an ignition cycle. However, since the effective mean value of pressure $P_i$ and the maximum value of inner pressure $P_{max}$ has a single peak characteristic to an air-fuel ratio, an additional judgement as to whether an air-fuel ratio is rich or lean is necessary when the method of control is actually used. On the other hand, the present invention is advantageous in that it is unnecessary to use such judgement of air-fuel ratio being rich or lean since there is no single peak characteristic in the relation between the maximum value $(dP/d\theta)_{max}$ and an air-fuel ratio.

Further, the present invention provides such a feature that when the value $(dP/d\theta)_{max}$ is used, it is unnecessary to regulate a graphically represented effective mean value of pressure $P_i$ or a maximum pressure $P_{max}$ on the basis of a load.

FIG. *7a* is a flow chart showing a flow of operations in an embodiment of the present invention, particularly, it is a flow chart in which a value $(dP/d\theta)_{max}$ in an ignition cycle is obtained. In more detail, in the flow chart shown in FIG. *7a*, a cylinder pressure is sampled at each one degree of crank angle, and calculation is executed by a coprocessor wherein one cycle is used as a predetermined number of cycles.

In a routine (a coprocessor) as shown in FIG. *7a* which is followed by a main routine (a host processor), a crank angle is read at Step 100. At Step 101, determination is made as to whether or not the crank angle obtained at Step 100 is in a compression stroke or a combustion stroke (an expansion stroke). When "YES", a cylinder pressure $P(\theta)$ is read at Step 102. When "NO", then Step 100 is taken to receive information of crank angle.

At Step 103, determination is made as to whether or not the crank angle is in an intake BDC. When "YES", $P1=P(\theta)$ and $\Delta P=0$ are respectively set by using the data of cylinder pressure $P(\theta)$, and respectively the values of P1 and $\Delta P$ are memorized (Step 104), and then, the sequential step is returned to Step 100.

When "NO" at Step 103, determination is made as to whether or not the crank angle is in a combustion (expansion) BDC at Step 105. When "NO", $\Delta P2=P(\theta)-P1$ and $\Delta P=\Delta P2-\Delta P1$ are respectively calculated, and the resulted $\Delta P2$ and $\Delta P$ are respectively memorized, and Step 107 is taken.

When "YES" (i.e., in the combustion stroke or the expansion stroke), the subsequent operations go to a step in FIG. *7b*.

At Step 107, determination is made as to whether or not $\Delta P \geqq 0$. When "YES", $\Delta P1=\Delta P2$ is set to renew the memorized value $\Delta P1$ (Step 108), and then the next operation moves to Step 100 in the same manner as the case that when "NO". By following the above-mentioned steps, the maximum value of a pressure increasing rate $(dP/d\theta)_{max}$ in cylinder can be obtained. Namely, when "YES" is obtained at Step 105, the maximum value of an increasing rate of an inner pressure of cylinder can be obtained as a memorized value of $\Delta P1$. In this embodiment, since a crank angle is sampled each one degree, a value of pressure difference dP and pressure gradient $(dP/d\theta)$ are respectively the same at each sampling angle. Accordingly, it is unnecessary to divide the pressure difference dP by a sampled crank angle.

When the engine is rotated at a high speed and it is impossible to sample a crank angle each one degree (for instance when the engine speed is more than 3,000 rpm, it is necessary to sample each 2° of crank angle), the maximum value $(dP/d\theta)_{max}$ can be obtained in the same manner as the case using a sampled crank angle of each 1° by dividing each value of $\Delta P1$, $\Delta P1$, $\Delta P2$, $\Delta P$ in Step 106, 107 and 108 by a sampled crank angle distance.

A series of the calculations as above-mentioned has to be carried out at an extremely high speed (for instance, the routine as shown in FIG. *7a* has to be carried out within a time of a crank angle of 1° ). Such high speed calculation is possible by using, for instance, a data-flow type processor (such as μPD7281 manufactured by Nippon Denki Kabushiki Kaisha) as a coprocessor.

A host processor (such as a Neumann type processor) can be used to carry out operations such as decision of an engine operating point, calculations of the fuel injection quantity $T_i$ as in FIG. *7b*, and a control of air-fuel ratio and the routine as shown in FIG. *7a*.

Figure 7A:
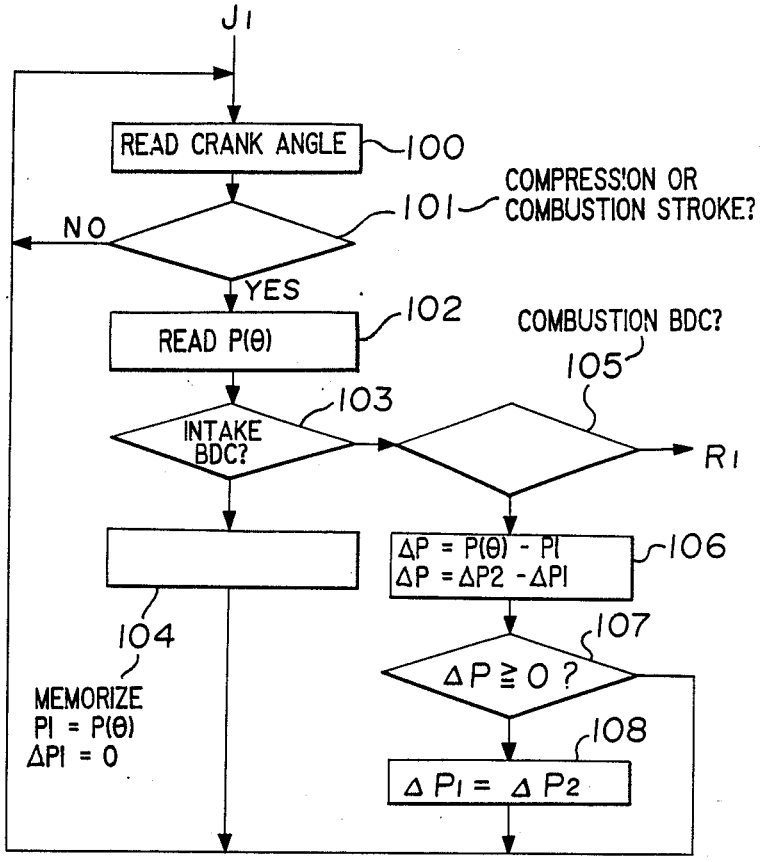
FIGS. 7a and 7b are flow charts showing a flow of operations of the above-mentioned embodiment.

A data-flow type processor is so adapted that operations are effected by data. Accordingly, the connection to the routine as shown in FIG. 7*a* can be made as follows. For instance, when a signal of crank angle is inputted to a host processor, it sends data of crank angle and inner pressure of cylinder $P(\theta)$ to a coprocessor which stores the operating program as shown in FIG. 7*a*. This can be done because the data-flow type processor can operate automatically when requesite data are provided.

When an operational step shown in FIG. 7*a* reaches R1 (namely, when "YES" at Step 105), it is sufficient that the data flow type processor returns to the host processor the data of the maximum value of pressure increasing rate of cylinder $(dP/d\theta)_{max}$ which are stored at $\Delta P1$. The host processor executes a control of air-fuel ratio as shown in the flow chart of FIG. 7*b*.

When a self-supporting data-flow type processor is used as the host processor, it is possible to obtain the maximum value of pressure increasing rate of cylinder $(dP/d\theta)_{max}$ by executing the operational program as shown in FIG. 7*a*, which is actuated by the data of crank angle.

In the above-mentioned embodiment, the maximum value $(dP/d\theta)_{max}$ is obtained on an operational program. However, it is possible to obtain the maximum value by means of a circuit such as a peak value holding circuit.

Figure 7B:
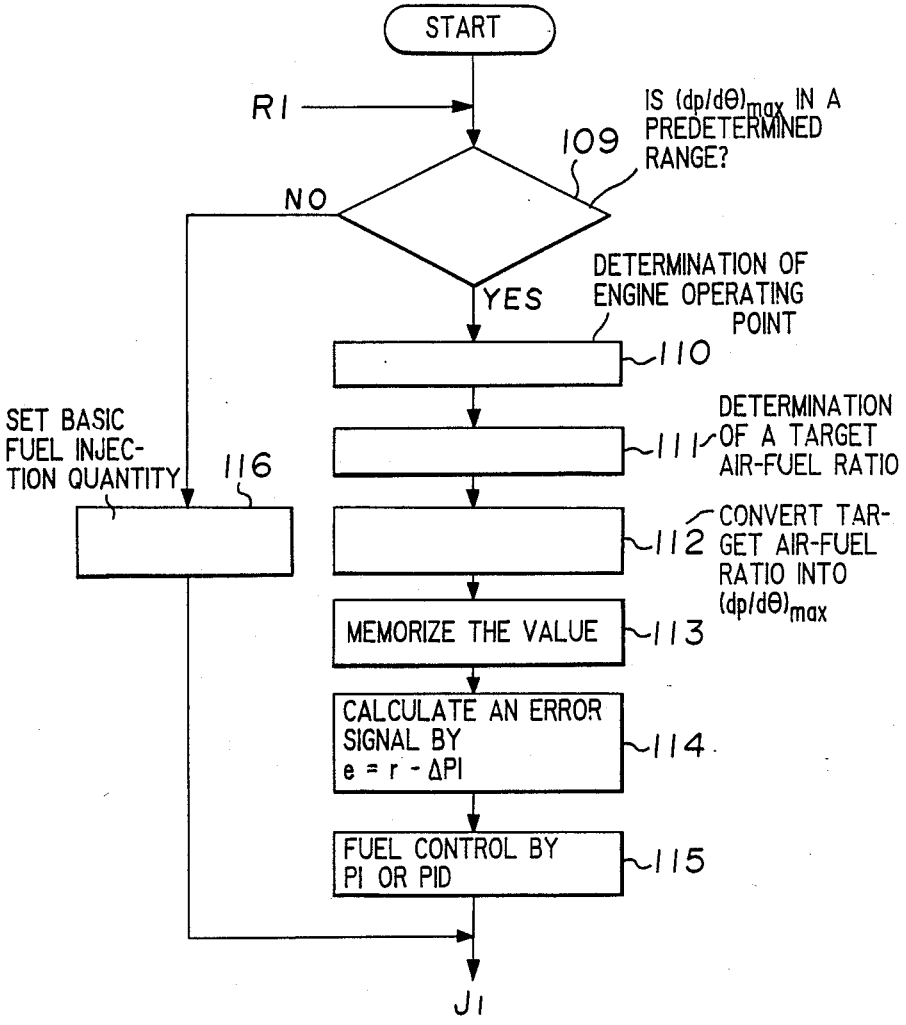

The flow chart shown in FIG. 7*b* is an example of an air-fuel ratio control which is to be executed by a host processor. Namely, at Step 109, determination is made as to whether or not the maximum value of pressure increasing rate $(dP/d\theta)_{max}$ obtained in the FIG. 7*a* program is in a predetermined range. When the maximum value is in the range, Step 110 is taken. When "NO", a fuel injection quantity is determined to be a basic fuel injection quantity at Step 116, and execution of the air-fuel ratio control is stopped. At Step 110, an engine operating point is obtained from an engine revolution number N and an intake air-quantity Q or an intake air pipe pressure $P_b$; a target air-fuel ratio corresponding to the engine operating point is obtained from a data table (Step 111) and the target air-fuel ratio is rewritten to be a maximum value of pressure increasing rate $(dP/d\theta)_{max}$ at Step 112. The maximum value $(dP/d\theta)_{max}$ rewritten at Step 112 is memorized at Step 113. Then, a calculation of $e=r-\Delta P1$ is made at Step 114 to thereby prepare an error signal which is needed to effect a feed-back control, and then, a control of PI (proportionating and integrating) or PID (proportionating, integrating and differentiating).

In the above-mentioned embodiment, a case that the absolute value of an inner pressure of cylinder can be detected has been described. However, the present invention is applicable to a case that a rate of pressure change is detected.

Since the above-mentioned embodiment of the present invention is so adapted that an air-fuel ratio is controlled by detecting a maximum value of a pressure increasing rate $(dP/d\theta)$ of cylinder in an ignition cycle or the mean value of the maximum values in a predetermined number of cycles, and air-fuel ratio is correctly controlled regardless of a load on the engine or an engine revolution number.

The second embodiment of the fuel control apparatus of the present invention will be described.

Figure 8:
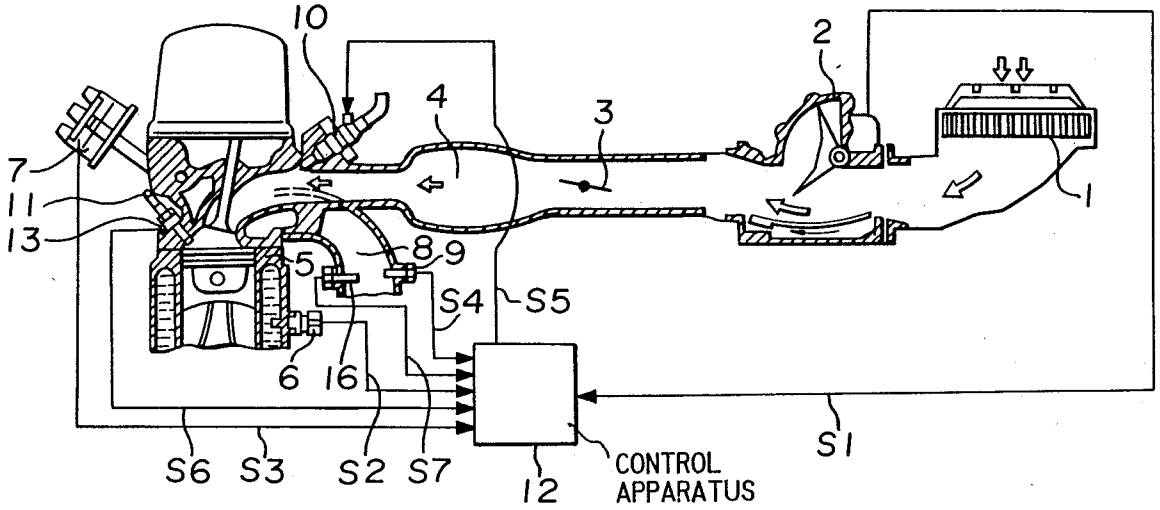
FIG. 8 is a diagram showing another embodiment of the air-fuel ratio control apparatus for an internal combustion engine according to the present invention.

FIG. 8 is a diagram showing the overall structure of the air-fuel ratio control apparatus schematically. The construction of the apparatus shown in FIG. 8 is the same as that of the first embodiment shown in FIG. 1 provided that an exhaust gas temperature sensor is provided at an exhaust pipe so that a temperature signal S7 detected is inputted to a control apparatus 12 to be subjected to operations as well as the other signals from various sensors.

The operation of the second embodiment will be described.

Figure 9:
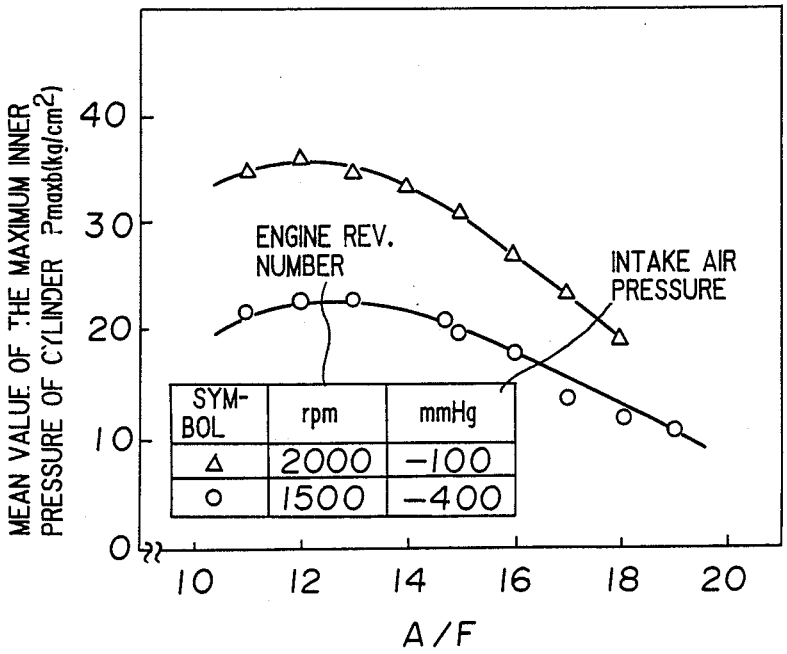
FIG. 9 is a characteristic diagram showing the relation between the mean value $P_{maxb}$ of the maximum values of inner pressure of cylinder in an ignition cycle and air-fuel ratios.

FIG. 9 is a diagram showing the relation between air-fuel ratios (A/F) and the mean values of maximum pressures of cylinder $P_{maxb}$. As is understandable from FIG. 9, the mean values $P_{maxb}$ show a single peak characteristic to air-fuel ratios, and therefore, an air-fuel ratio can not be detected by using only the mean value $P_{maxb}$. Namely, judgement of the air-fuel ratio being rich or lean is separately and additionally required.

On the other hand, in accordance with the second embodiment of the present invention, an air-fuel ratio can be correctly detected by utilizing an exhaust gas temperature as the second parameter for detecting the air-fuel ratio.

Figure 10:
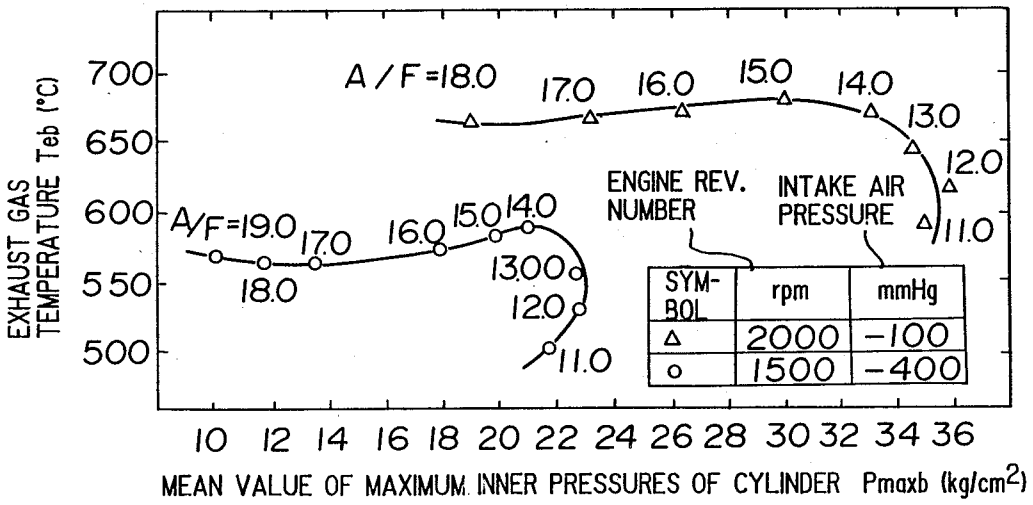
FIG. 10 is a characteristic diagram showing the relation among the mean value $P_{maxb}$ of the maximum values of inner pressure of cylinder in an ignition cycle, exhaust gas temperatures $T_{eb}$ and air-fuel ratios.

FIG. 10 shows the relation between the mean value $P_{maxb}$ of the maximum inner pressures of cylinder and the exhaust gas temperature $T_{eb}$. In FIG. 10, the ordinate represents the exhaust gas temperature $T_{eb}$ and the abscissa represents the mean value $P_{maxb}$ of the maximum inner pressures of cylinder. Namely, an air-fuel ratio can be detected even though the values of load and an engine revolution number change. Accordingly, an air-fuel ratio can be controlled by detecting the relation between the exhaust gas temperature $T_{eb}$ and the mean value $P_{maxb}$ which change depending on operational conditions of the engine wherein the data concerning the above-mentioned relation are held in a data table in a form of map.

The mean value $P_{maxb}$ of the maximum inner pressures of cylinder can be obtained by dividing the maximum inner pressure values by a predetermined number of cycles when a crank angle $\theta$ is measured and by dividing that values by a predetermined time when the crank angle $\theta$ is not measured.

Figure 11A:
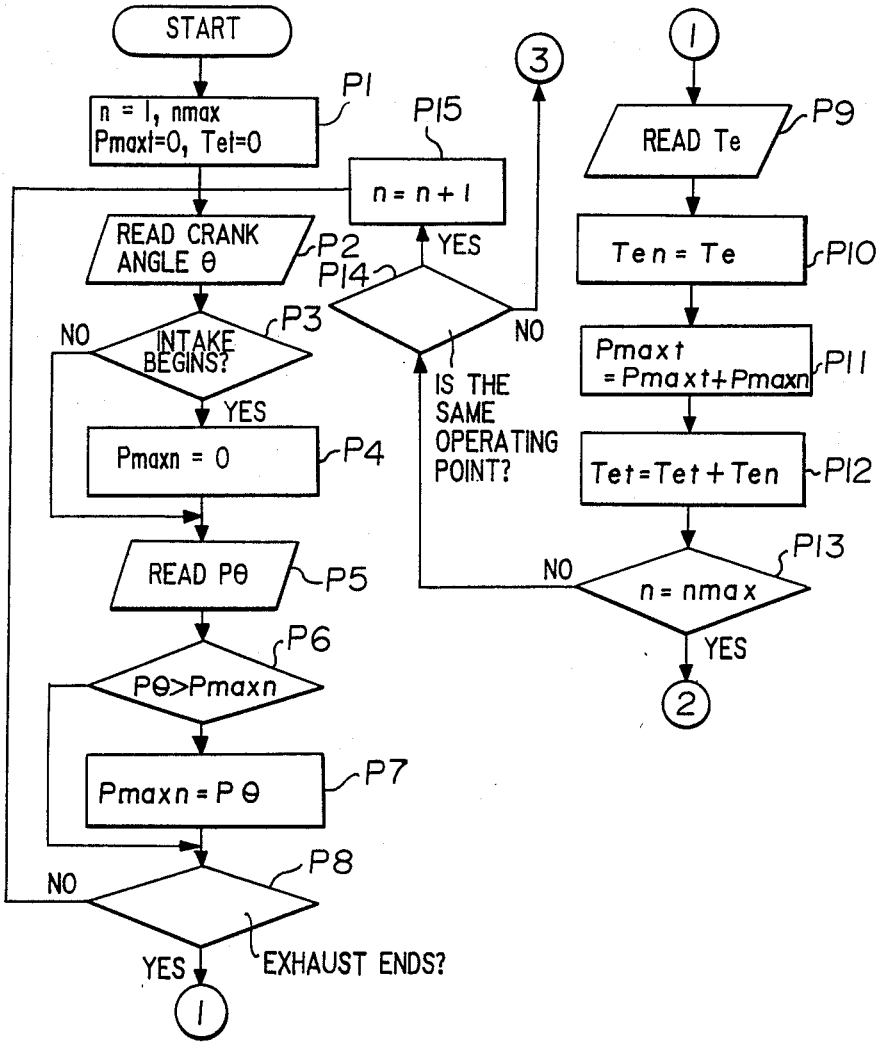
FIGS. 11A and 11B are respectively flow charts showing a flow of operations of the embodiment shown in FIG. 8.
Figure 11:
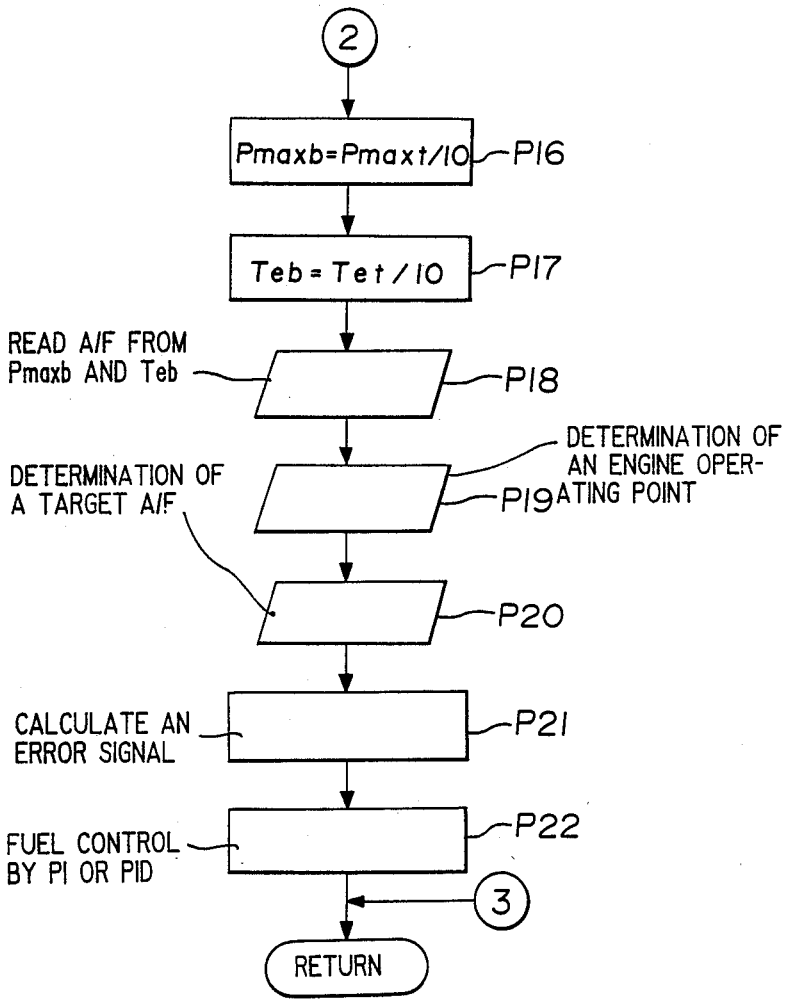

FIG. 11 is a flow chart showing an example of obtaining the mean value wherein inner pressures of cylinder are measured at, for instance, each sampling time of crank angle of 1°. The sampling crank angle can be changed depending on operational conditions of the engine. A series of calculation steps in the flow chart is conducted in an interruption routine when a condition of heavy load is satisfied in the main program of host processor which controls the entirety of engine operations.

In FIG. 11, symbols P1, P2, P3 . . . show steps in accordance with the order of processing.

In FIG. 11A, the number of sampling cycles n is set to "1" and a memory which stores the total value $P_{maxt}$ of the maximum inner pressures of cylinder and the total value $T_{et}$ of exhaust gas temperatures is cleared to be zero.

At Step P2, a crank angle $\theta$ is read. Then, at Step P3, determination is made as to whether or not the crank angle $\theta$ read at Step P2 is in an intake stroke (intake TDC).

When "YES" (affirmative) at Step P3, the maximum value of the inner pressure of cylinder $P_{maxn}$ is cleared to be zero at Step P4, and then, an inner pressure of cylinder $P(\theta)$ at the time of the zero-clearing is read at Step P5.

When "NO" (negative) at Step P3, the value $P(\theta)$ is read at Step P5.

At Step P6, determination is made as to whether or not the inner pressure of cylinder $P(\theta)$ read at Step P5 is greater than the maximum inner pressure $P_{maxn}$ upto the previous calculating steps. When "NO" at Step P6, then, Step P8 is immediately taken. On the other hand, when "YES" at Step P6, the inner pressure of cylinder $P(\theta)$ at the present time is memorized as a newly determined maximum value of inner pressure of cylinder $P_{maxn}$ at Step P7.

At Step P8, determination is made as to whether or not the crank angle $\theta$ is at the ending time of an exhaust stroke. When "YES", it is deemed that one ignition cycle is finished, and Step P9 is taken. On the other hand, when "NO" at Step P6, the sequential step is returned to Step P2 to repeat the above-mentioned processes.

At Step P9, an exhaust gas temperature $T_e$ is read, and the read valve is stored as an exhaust gas temperature $T_{en}$ at the present time (Step P10).

In order to obtain the mean value of the maximum inner pressures of cylinder $P_{maxn}$, the total value of the maximum values $P_{maxn}$ is calculated and thus obtained total value $P_{maxt}$ is memorized (Step P11). In the same manner as the above, the total value of the exhaust gas temperatures $T_{en}$ is calculated and thus obtained total value of exhaust gas temperature $T_{et}$ is memorized (Step P12).

At Step P13, determination is made as to whether or not the number of cycles n approaches a predetermined value. The predetermined value is variable and is determined as a value nmax depending on the engine operating point at the time when the main program in the host processor is interrupted by the program of FIG. 11A, the number of cycle n being given at Step P1.

When "YES" at Step P13, the sequential step goes to Step P16 in FIG. 11B. On the other hand, when "NO" at Step P13, Step P14 is taken where determination is made as to whether or not the operating point of engine is equal to that of the previous time.

When "YES" at Step P14, the number of sampling cycles n is set as $n=n+1$ at Step P15 and then the sequential step is returned to Step P2.

When "NO" at Step P14, judgement is made such that the engine operating point is changed during the sampling, and processes in the main program are carried out.

FIG. 11B shows a flow chart of air-fuel ratio control. Namely, at Step 16, the mean value of the maximum inner pressures of cylinder $P_{maxb}$ is obtained from the total value $P_{maxt}$ obtained at Step P11 and the number of sampling cycles n.

At Step P17, the mean value $T_{eb}$ of exhaust gas temperatures is obtained from the exhaust gas temperatures $T_{et}$ obtained at Step P12 and the number of cycles n.

At Step P18, a value of air-fuel ratio (A/F)b in the relation between the mean value $P_{maxb}$ obtained at Step P16 and the mean value of $T_{eb}$ obtained at Step P17 is obtained by seeking operations of the data table.

On the other hand, an engine operating point is obtained from an engine revolution number N and an intake air quantity Ga or an intake air pipe pressure Pb at Step P19, and a target air-fuel ratio (A/F)m in response to the engine operating point is seeked from the data table.

At Step P21, an error signal required for a feed-back control is prepared by a calculation of $e=(A/F)b-(A/F)m$; namely, the difference between the value (A/F)b obtained at Step P19 and the value (A/F)m obtained at Step P20. At Step P22, a PI (proportionating and integrating) control or a PID (proportionating, integrating and differentiating) control is effected.

Thus, in the operations in FIGS. 11A and 11B, an air-fuel ratio for an engine can be precisely controlled so as to maintain a target air-fuel ratio by a feed-back control of the air-fuel ratio by using the mean value of the maximum inner pressures of cylinder $P_{max}$ and the exhaust gas temperature $T_e$.

In the same manner as the first embodiment of the present invention, a host processor and a coprocessor are used to conduct operations of the routines and a control of the flow of processes as in FIGS. 11A and 11B.

Figure 12:
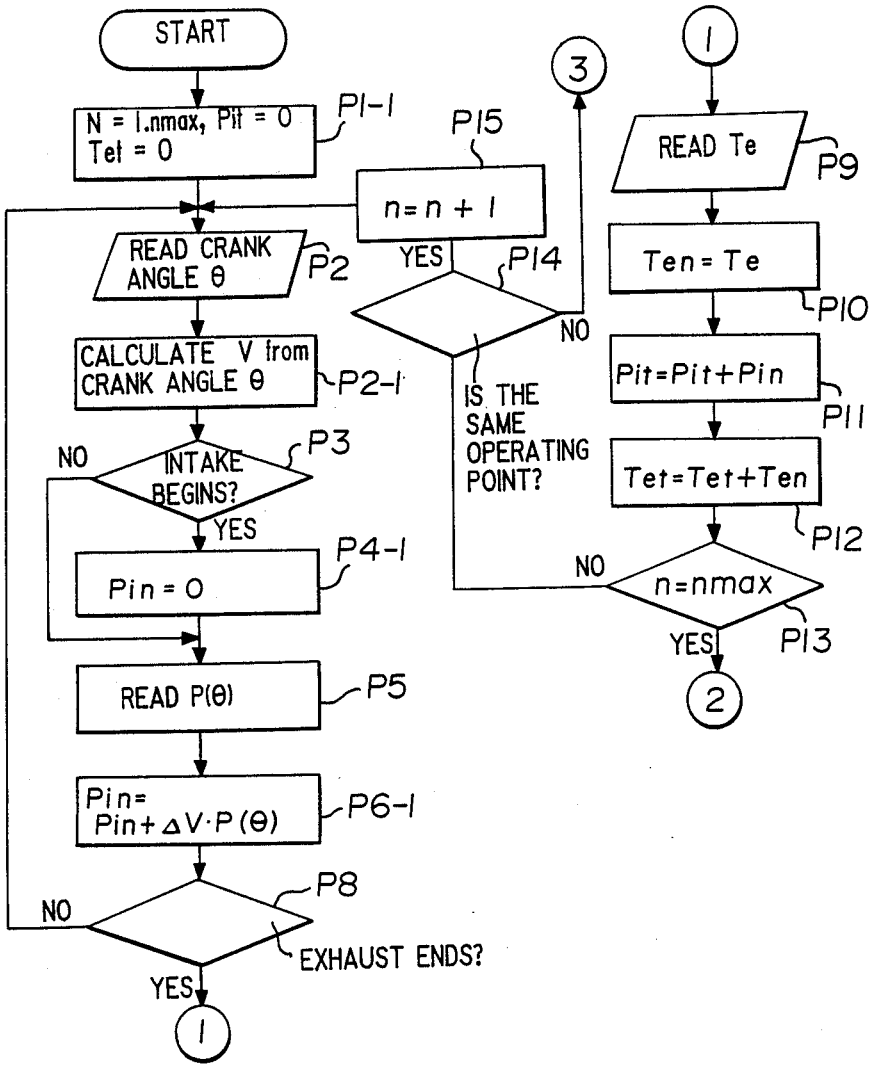
FIGS. 12A and 12B are respectively flow charts showing a flow of operations of the another embodiment of the air-fuel ratio control apparatus according to the present invention.
Figure 12:
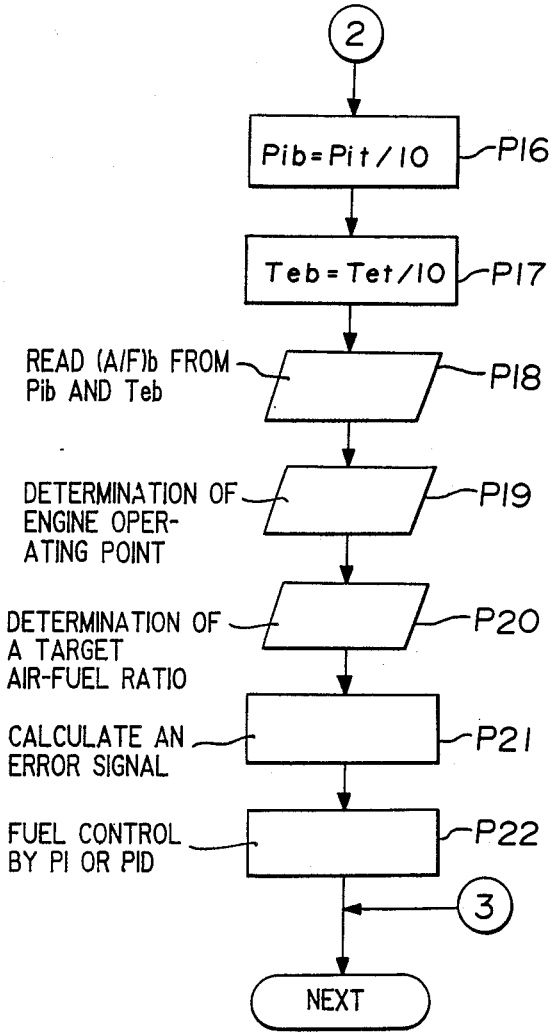

FIG. 12 is a flow chart showing a modified embodiment of operations of the second embodiment of the present invention.

At Step P1-1 in FIG. 12A, the number of sampling cycles n is set to "1", and a memory storing the total value of graphically represented effective average pressure $P_{it}$ and the total value of exhaust gas temperature $T_{et}$ is cleared to be zero.

At Step P2, a crank angle $\theta$ is read. At Step P2-1, a quantity of a change of stroke volume $\Delta V$ in each time when a crank angle $\theta$ changes by a predetermined angle (for instance, 1°) read at Step P2 is calculated. The quantity of change $\Delta V$ may be read from a data table which is previously prepared so as to correspond to crank angles. At Step P3, determination is made as to whether or not the crank angle $\theta$ read at Step P2 is at the beginning of an intake stroke (intake TDC). When "YES" (affirmative) at Step P3, Step P4-1 is taken where the graphically represented effective average pressure $P_{in}$ is cleared to be zero, and an inner pressure of cylinder $P(\theta)$ is read at the time of the zero-clearing at Step P5. On the other hand, when "NO" (negative) at Step P3, Step P5 is taken to read an inner pressure of cylinder $P(\theta)$.

Then, the graphically represented effective average pressure $P_{in}$ is calculated at Step P6-1. The graphically represented effective average pressure $P_{in}$ is a value obtained by dividing the work of a piston given by combustion gas in an ignition cycle by a volume of stroke. The effective average pressure $P_{in}$ can be approximately obtained by using the following equation:

$$P_{in}=P_{in}+\Delta V+P(\theta) \quad (1)$$

where $P(\theta)$ is an inner pressure of cylinder at each crank angle and $\Delta V$ is a change of stroke volume at each time when the crank angle changes by a unit angle (such as 1°).

Namely, the inner pressure of cylinder $P(\theta)$ obtained by calculation at the present time is added to the quantity of change of stroke voluem $\Delta V$, and a summed value is added to the effective average pressure value $P_{in}$ obtained at the previous time (before a crank angle of 1°) to thereby being obtainable the value $P_{in}$ at the present time. (It is effective to use a data flow type processor so as to conduct a high speed calculation.)

At Step P8, determination is made as to whether or not the crank angle read at Step P2 reaches the end of an exhaust stroke.

When "YES" at Step P8, it shows that one ignition cycle is finished, and accordingly, Step P9 is taken. On the other hand, when "NO" at Step P8, the sequential step is returned to Step P2 to repeat the above-mentioned processes.

The Steps P9–P13 in FIG. 12A are the same processes as those in FIG. 11A when the value $P_{maxt}$ is replaced by the value $P_{it}$. Further, the Steps P16–P22 in FIG. 12B are the same processes as in FIG. 11B when a value $P_{maxt}$ and the mean value $P_{maxb}$ are respectively replaced by the value $P_{it}$ and the value $P_{ib}$.

Figure 13:
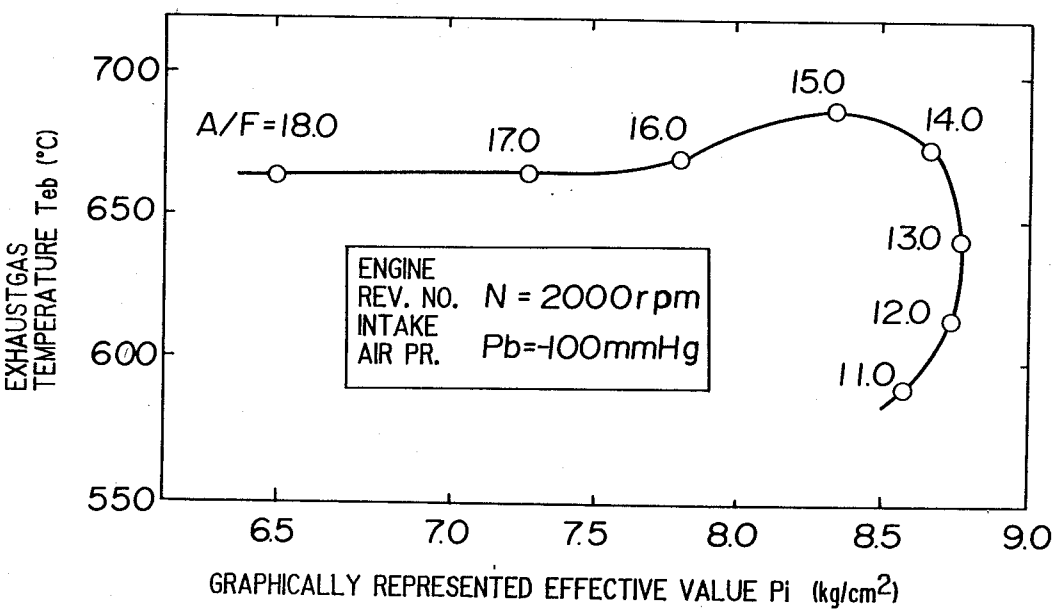
FIG. 13 is a characteristic diagram showing the relation among the mean values of graphically represented effective average pressures, exhaust gas temperatures $T_{eb}$ and air-fuel ratios to explain the embodiment as shown in FIG. 12.

Thus, in the steps as shown in FIGS. 12A and 12B, an air-fuel ratio for an engine can be precisely controlled so as to maintain a target air-fuel ratio because the air-fuel ratio is subjected to a feed-back control by using the graphically represented effective average pressure $P_i$ and the exhaust gas temperature $T_i$. The relation among $P_i$, $T_e$ and air-fuel ratio is shown in FIG. 13.

Figure 14:
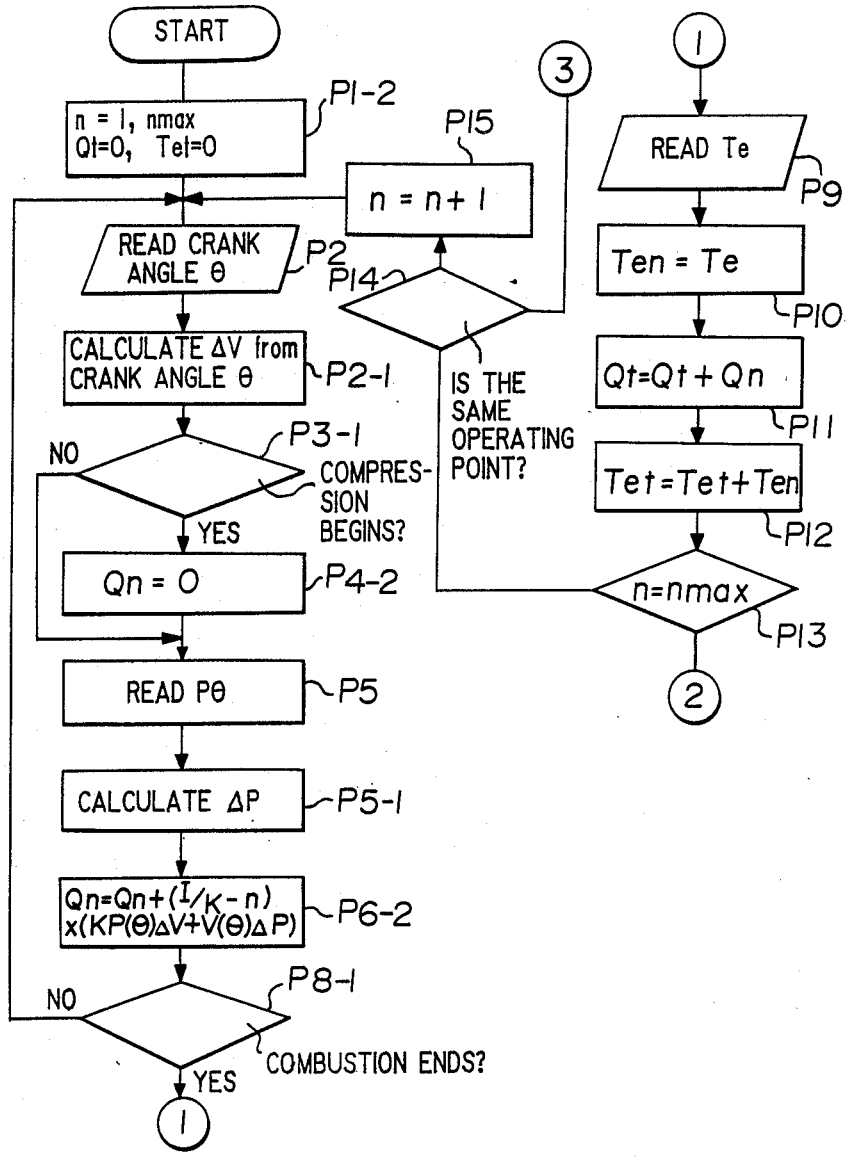
FIGS. 14a and 14b are respectively flow charts showing a flow of operations of still another embodiment of the present invention.
Figure 14:
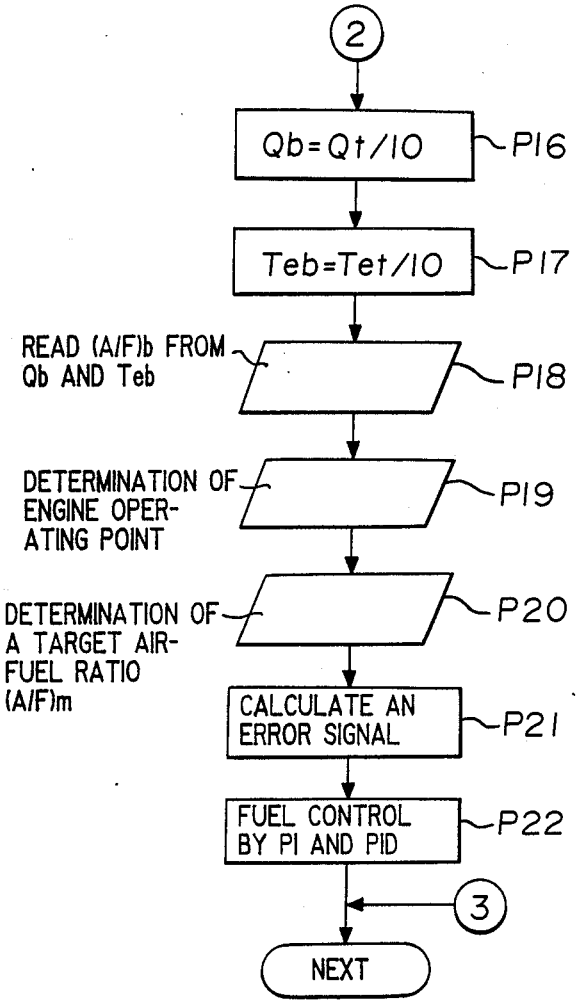

FIG. 14 is a flow chart showing still another embodiment of operation of the present invention.

At Step P1-2 in FIG. 14A, the number of sampling cycles n is set to "1" and a memory storing the total value of calorie $Q_t$ and the total value of exhaust gas temperature $T_{et}$ is cleared to be zero.

At Step P2, a crank angle $\theta$ is read. At Step P2-1, a quantity of change of stroke volume $\Delta V$ at the change of the crank angle $\theta$ (which is read at Step P2) by a predetermined angle (such as 1°) is calculated.

At Step P3-1, determination is made as to whether or not the crank angle $\theta$ read at Step P2 is at the begining of compression stroke (compression BDC). When "YES" (affirmative) at Step P3-1, a value of calorie $Q_n$ is cleared to be zero at Step P4-2, and the inner pressure of cylinder $P(\theta)$ at the zero-clearing time is read at Step P5. When "NO" (negative) at Step P3-1, the value $P(\theta)$ is read at Step P5.

At Step P5-1, a quantity of change of cylinder inner pressure $\Delta P$ at each time of change of the crank angle $\theta$ (read at Step P2) by a predetermined angle (such as 1°) is calculated.

Then, a value of calorie $Q_n$ is calculated by using the quantity of change of stroke volume obtained at Step P2-1 and the quantity of change of cylinder inner pressure $\Delta P$ obtained at Step 5-1. The value of calorie $Q_n$ is the difference between a calorie $Q_r$ produced by the combustion of fuel in an ignition cycle and a calorie $Q_c$ released from the cylinder wall and the piston (see equation (2)). The value of calorie $Q_n$ can be approximately obtained by using the following equation (3) when a quantity of change of stroke volume at each time of the change of the crank angle $\theta$ by a unit angle (such as 1°) is represented by $\Delta V$ and a quantity of change of cylinder inner pressure is $\Delta P$.

$$Q_n = Q_r - Q_c \quad (2)$$

$$Q_n = Q_n + 1/K + 1(K^*P(\theta)^*\Delta V + V(\theta)^*\Delta P \quad (3)$$

Determination is made as to whether or not the crank angle read at Step P2 reaches the end of combustion stroke (Step P8-1). When "YES" at Step P8-1, it shows that a period in which heat is generated in one ignition cycle is finished, and Step P9 is taken.

When "NO" at Step P8-1, the sequential step is returned to Step P2 to repeat the above-mentioned processes.

The Steps P9–P13 as shown in FIG. 14A are the same processes as those in FIG. 11A if the value $P_{maxt}$ is replaced by the value $Q_a$. Further, the Steps P16–P22 as shown in FIG. 14B are the same processes as those in FIG. 11B if the mean value $P_{maxb}$ and the total value $P_{maxt}$ are respectively replaced by the values $Q_b$ and $Q_t$.

Thus, in calculation of values in the steps of FIG. 14A and 14B, an air-fuel ratio for an engine can be precisely controlled so as to maintain a target air-fuel ratio because the air-fuel ratio is feed-back-controlled by using the value of calorie Q and the exhaust gas temperature $T_e$.

Figure 15:
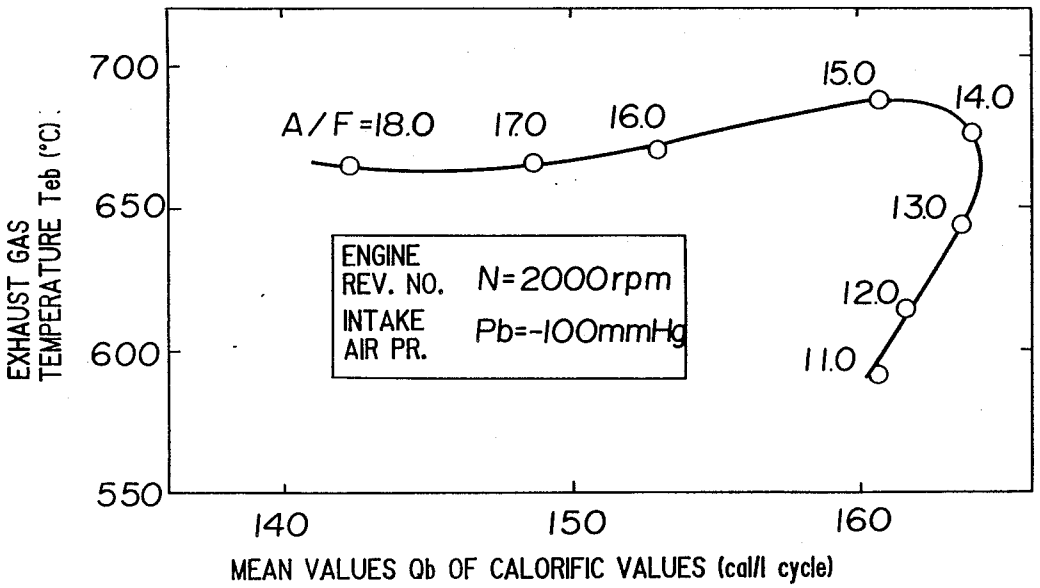
FIG. 15 is a characteristic diagram showing the relation among the means values $Q_b$ of carolific values, exhaust gas temperatures $T_{eb}$ and air-fuel ratios to explain the embodiment as shown in FIG. 14.

FIG. 15 shows the relation among the value of calorie $Q_b$, the exhaust gas temperature $T_{ed}$ and air-fuel ratios. When the graphically represented effective average pressure $P_{in}$ is calculated, it is necessary to measure inner pressures of cylinder during one ignition cycle. However, when the value of calorie $Q_n$ is calculated, it is sufficient to measure each inner pressure of cylinder in a compression stroke related to combustion and a combustion stroke. This substantially reduces cost for hard wear for measuring.

In the embodiment shown in FIG. 8, only one cylinder is shown. However, it is possible to control a correct amount of fuel injection quantity for each cylinder in response to signals from a pressure sensor and a load sensor attached to each of the cylinders when a multi cylinder engine is used.

In the present invention, a fuel injection quantity may be corrected by measuring an inner pressure of cylinder detected by a pressure sensor which can be attached to each cylinder or only one cylinder.

In accordance with the second embodiment of the present invention, an air-fuel ratio is feed-back-controlled by detecting a state quantity obtained from an inner pressure of cylinder and an exhaust gas temperature. Accordingly, the engine can be operated while maintaining a target air-fuel ratio even when there are scattering in dimension of the structural elements of the engine and deterioration of material of the elements.

Obviously, numerous modifications and variations of the present invention are possible in light of the above teachings. It is therefore to be understood that within the scope of the appended claims, the invention may be practiced otherwise than as specifically described herein.

What is claimed is:

1. An air-fuel ratio control apparatus for an internal combustion engine adapted to measure an intake air quantity and an engine revolution number to thereby calculate a basic fuel injection quantity based on said measured intake air quantity and said engine revolution number and to output an instruction signal to inject an amount of fuel to a cylinder, which comprises a pressure detecting means to detect an inner pressure of cylinder, a crank angle detecting means to detect a crank angle of the engine, and a control device which is adapted to receive the output signals of said pressure detecting means and said crank angle detecting means so as to obtain the maximum value of a rate of pressure increase in an ignition cycle of the engine or the mean value of the maximum values in a predetermined number of cycles of the engine, and to control a fuel injection quantity in response to the thus obtained maximum value or the mean value.

2. The air-fuel ratio control apparatus according to claim 1, wherein said control device effects a feed-back control of an air-fuel ratio by the maximum value of a rate of pressure increase or the mean value of the maximum values in a predetermined number of cycles.

3. The air-fuel ratio control apparatus according to claim 1, wherein a rate of pressure increase per a unit crank angle in an ignition cycle or a rate of pressure increase per unit time is used in order to obtain said maximum value.

4. The air-fuel ratio control apparatus according to claim 2, wherein said control device is adapted to stop said feed-back control of an air-fuel ratio when said maximum value of a rate of pressure increase or the mean value of the maximum values in a predetermined number of ignition cycles is out of a predetermined range.

5. An air-fuel ratio control apparatus for an internal combustion engine adapted to measure an intake air quantity and an engine revolution number to thereby calculate a basic fuel injection quantity based on said measured intake air quantity and said engine revolution number and to output an instruction signal to inject an amount of fuel to a cylinder, which comprises a pressure detecting means to detect an inner pressure of cylinder, a crank angle detecting means to detect a crank angle of the engine, an exhaust gas temperature detecting means to detect a temperature of exhaust gas and a control device which is adapted to receive the output signals of said pressure detecting means, said crank angle detecting means and said exhaust gas temperature detecting means, to calculate a state quantity based on the signals of said inner pressure of cylinder in an ignition cycle, and to control a fuel injection quantity by using said state quantity and a value of exhaust gas temperature $T_e$ obtained by the output of said exhaust gas temperature detecting means.

6. The air-fuel ratio control apparatus according to claim 5, wherein the maximum value $P_{max}$ of an inner pressure of cylinder in an ignition cycle, a graphically represented effective average pressure $P_i$ or a calorific value Q is calculated to obtain a mean value $T_{eb}$ in a predetermined period, and said feed-back control of air-fuel ratio is effected on the basis of said state quantity, said exhaust gas temperature $T_e$ and said mean value $T_{eb}$ in predetermined period.

7. The air-fuel ratio control apparatus according to claim 6, wherein said predetermined period used for obtaining the mean value of the maximum inner pressure of cylinder $P_{maxb}$ is a predetermined number of cycles or a predetermined time, and said predetermined period for said graphically represented effective average pressure $P_i$ or said calorific value Q is a predetermined number of cycles.

8. The air-fuel ratio control apparatus according to claim 7, wherein said predetermined number of cycles or said predetermined time is changed depending on an operating point of the engine.

* * * * *